US007068248B2

(12) United States Patent
Ahn et al.

(10) Patent No.: US 7,068,248 B2
(45) Date of Patent: Jun. 27, 2006

(54) COLUMN DRIVER FOR OLED DISPLAY

(75) Inventors: Sung Tae Ahn, Seoul (KR); Keunmyung Lee, Palo Alto, CA (US); Dae Young Ahn, Seoul (KR); Tae Kwang Park, Seoul (KR)

(73) Assignee: Leadis Technology, Inc., Sunnyvale, CA (US)

( * ) Notice: Subject to any disclaimer, the term of this patent is extended or adjusted under 35 U.S.C. 154(b) by 139 days.

(21) Appl. No.: 10/232,595

(22) Filed: Aug. 30, 2002

(65) Prior Publication Data

US 2003/0058203 A1 Mar. 27, 2003

Related U.S. Application Data

(60) Provisional application No. 60/325,304, filed on Sep. 26, 2001.

(51) Int. Cl.
*G09G 3/32* (2006.01)

(52) U.S. Cl. ..... 345/82; 345/103

(58) Field of Classification Search ..... 345/39, 345/76, 20, 82, 83, 204, 103; 315/169.3, 315/101; 313/505; 257/2–4
See application file for complete search history.

(56) References Cited

U.S. PATENT DOCUMENTS 5,170,158 A 12/1992 Shinya
5,420,604 A 5/1995 Scheffer et al.
5,572,211 A 11/1996 Erhart et al.
5,684,502 A 11/1997 Fukui et al.
5,689,280 A 11/1997 Asari et al.
5,719,589 A * 2/1998 Norman et al. ..... 345/82
5,747,363 A * 5/1998 Wei et al. ..... 438/5
5,754,157 A 5/1998 Kuwata et al.
5,764,212 A 6/1998 Nishitani et al.
5,786,799 A 7/1998 Matsui et al.
5,818,409 A 10/1998 Furuhashi et al.
5,852,429 A 12/1998 Scheffer et al.
5,877,738 A 3/1999 Ito et al.
5,900,856 A 5/1999 Iino et al.
6,040,815 A 3/2000 Erhart et al.
6,252,572 B1 6/2001 Kurumisawa et al.
6,366,026 B1 * 4/2002 Saito et al. ..... 315/169.3
6,417,827 B1 7/2002 Nagao et al.
6,483,497 B1 11/2002 Iino et al.
6,522,317 B1 2/2003 Satau et al.
6,611,246 B1 8/2003 Ito
6,750,469 B1 * 6/2004 Ichihara et al. ..... 257/2
6,861,810 B1 * 3/2005 Rutherford ..... 315/169.3
6,943,761 B1 * 9/2005 Everitt ..... 345/82
2001/0028346 A1 * 10/2001 Kudo et al. ..... 345/204

(Continued)

FOREIGN PATENT DOCUMENTS

EP 0837446 A1 4/1998

(Continued)

*Primary Examiner*—Ricardo Osorio
(74) *Attorney, Agent, or Firm*—Fenwick & West LLP

(57) ABSTRACT

A single-chip column driver for organic light emitting diode (OLED) display is disclosed. Instead of using two column drivers for dual scan, the present invention uses one column driver driving both the upper and the lower OLED panels. The column driver has a two set of output circuitry: one for driving the upper panel and the other for driving the lower panel. The single chip solution of the present invention eliminates the problem of display uniformity without increasing the part count. The invention also enables independent control of RGB without further increasing the part count.

9 Claims, 5 Drawing Sheets

U.S. PATENT DOCUMENTS

2001/0038385 A1* 11/2001 Negoi et al. ..... 345/204
2001/0050662 A1* 12/2001 Kota et al. ..... 345/76
2002/0018060 A1* 2/2002 Yamazaki et al. ..... 345/211
2002/0149608 A1 10/2002 Bu et al.
2002/0158585 A1* 10/2002 Sundahl ..... 315/169.3
2003/0011298 A1 1/2003 Palanisamy
2003/0151570 A1* 8/2003 LeChevalier et al. ..... 345/84

FOREIGN PATENT DOCUMENTS

JP 2000-172236 A 6/2000
JP 2000-258751 A 9/2000

* cited by examiner

FIG. 2 (Present Invention)

COLUMN DRIVER FOR OLED DISPLAY

RELATED APPLICATION

This application claims the benefit of co-pending U.S. Provisional Application Ser. No. 60/325,304, filed Sep. 26, 2001, entitled "Column Driver for OLED Display."

BACKGROUND OF THE INVENTION

1. Technical Field

This invention in general relates to semiconductor circuits. More specifically, this invention relates to circuits for driving columns of an organic light emitting diode (OLED) displays.

2. Description of the Related Art

Recently, much progress has been made in organic light emitting diode (OLED). An OLED display is made up of rows and column electrodes for selectively activating the OLED at each intersection. The row and column electrodes are driven by a row driver and a column driver, respectively. The row electrodes are scanned in sequence to refresh the display image.

As the OLED display becomes larger with an increased number of rows, the row scan frequency should increase, which reduces the time during which electric current is supplied for each OLED. In order to supply enough current for a shorter duration, a higher voltage needs to be supplied. The lifetime of an OLED device, however, deteriorates as current and voltage levels increase. In addition, in order to make the design withstand higher voltage application, a design rule of larger feature size as well as an expensive processing technology is needed.

In order to lengthen the lifetime, many OLED displays use a dual scan scheme. FIG. 1 shows the dual scan scheme where an OLED panel 10 is divided into an upper panel 11 and a lower panel 12. Although there is one row driver 13, there are two column drivers 14 and 15, each driver responsible for each half panel.

There are, however, several problems with the conventional dual-scan scheme. First, there is a problem with uniformity in brightness. Because there is a chip-to-chip variation in the output current, the brightness of the upper half panel is not the same as that of the lower half panel.

Second, there is a problem with the part count. Since the bright-current relationship is not the same for Red, Green, and Blue (RGB), it is preferable to independently control the different levels of current supply for R, G and B at a given brightness. If a single design is used for both upper and lower panel, when two column drivers are attached to the glass, the chip should be rotated by 180 degrees. This would not then allow individual control of the current level unless the second chip is prepared using a mirror image, which, in turn, would increase the part count.

Therefore, there is a need for a new column driver that can drive a dual-scanning OLED display with uniform brightness without increasing the part count.

SUMMARY OF THE INVENTION

It is an object of the present invention to provide a column driver for OLED display with a uniform brightness.

Another object of the present invention to provide a column driver for OLED display without the penalty of increasing the part count.

Yet another object of the present invention to provide an area-efficient column driver for OLED display.

The foregoing and other objects are accomplished by providing a single column driver driving both the upper and lower half OLED panel. The driver, preferably located at the center in the back of the display, has output pads at one end for driving the column electrodes of the upper panel and output pads at the other end for driving the column electrodes of the lower panel.

DETAILED DESCRIPTION OF THE INVENTION

Figure 1:
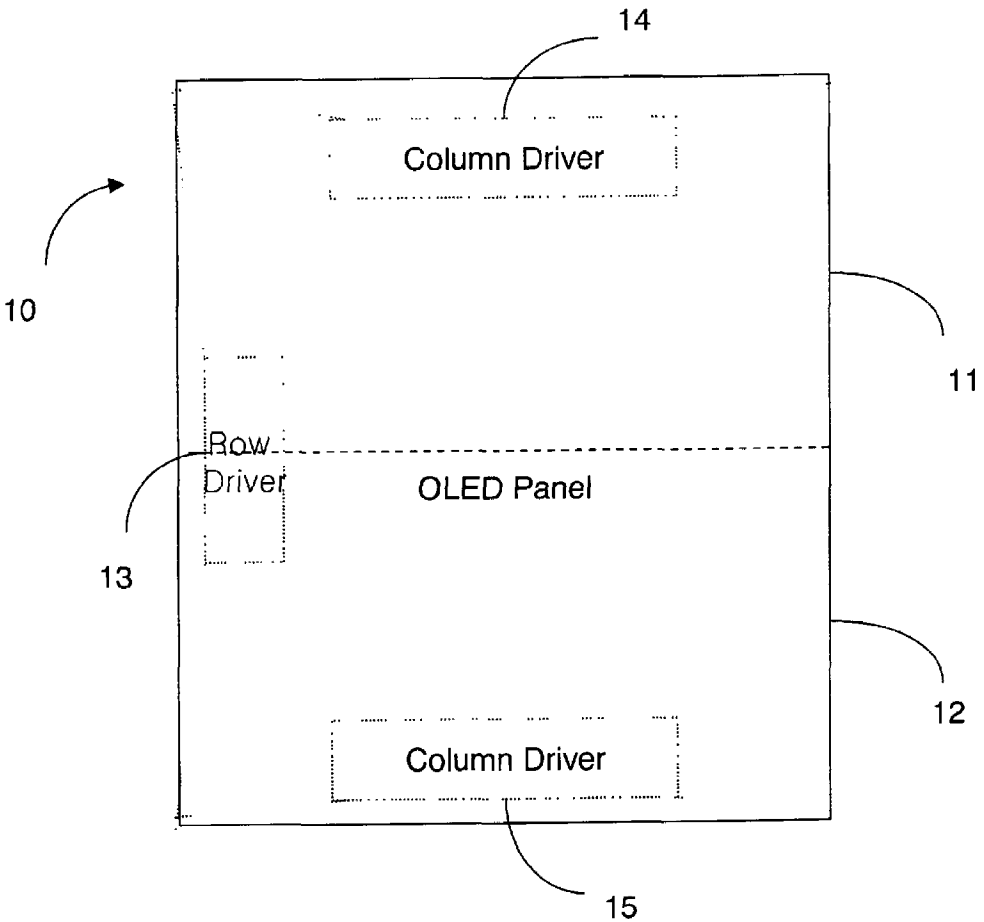
FIG. 1 (Related Art)
FIG. 1 shows a conventional scheme of using two column drivers for driving a dual-scan OLED display.
Figure 2:
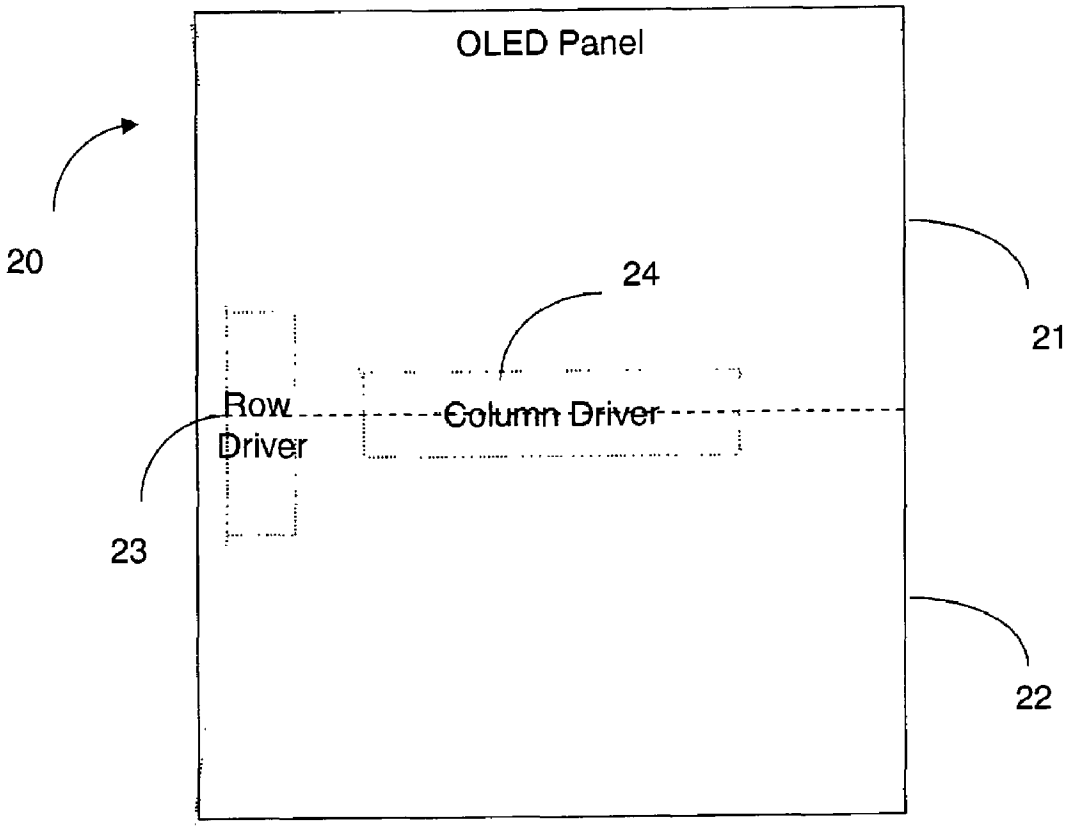
FIG. 2 shows a scheme of the present invention using one column driver for driving a dual-scan OLED display.

FIG. 2 shows a scheme of the present invention using one column driver for driving a dual-scan OLED display 20. In addition to a row driver 23 for selectively activating a row electrode, a single column driver 24 drives both the upper OLED panel 21 and the lower OLED panel 22.

Figure 3:
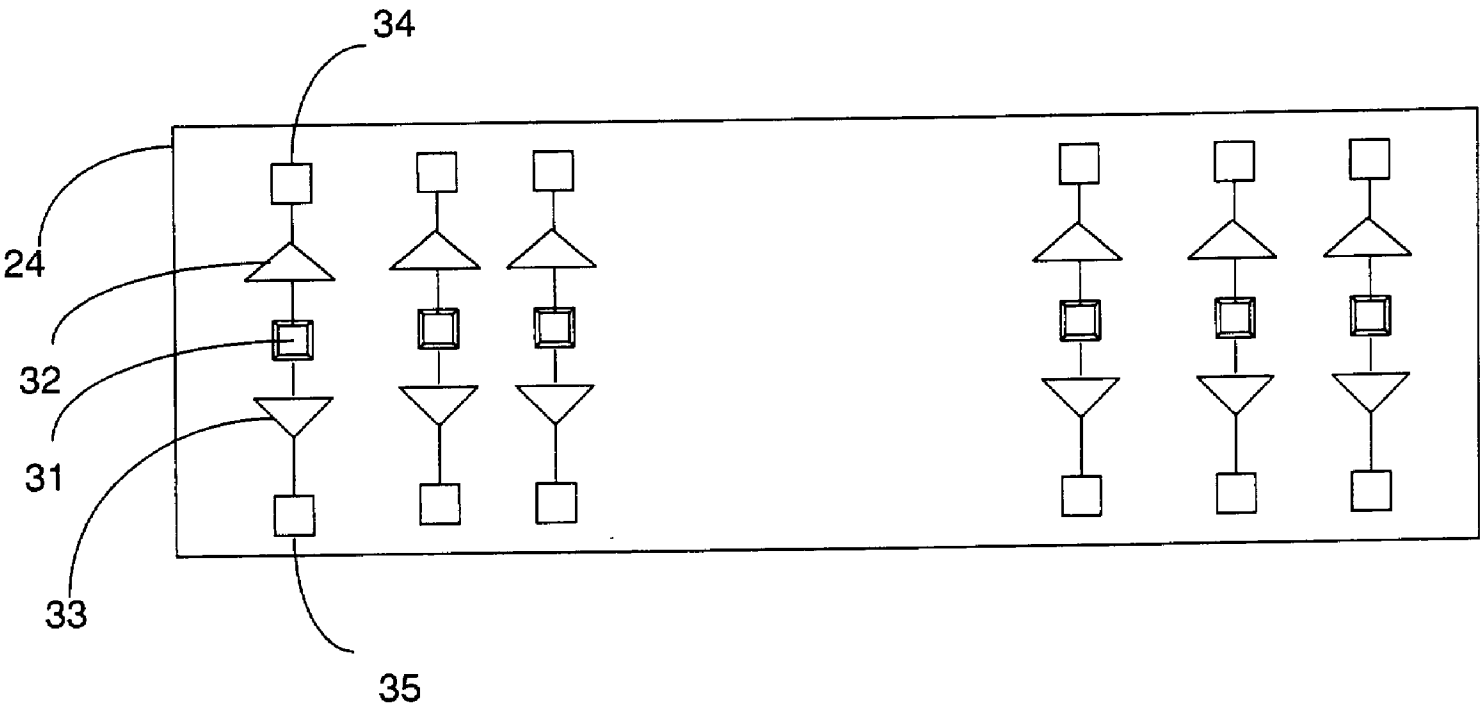
FIG. 3 shows a structure of a column driver of the present invention in further detail.

FIG. 3 shows the column driver 24 of FIG. 2 in further detail. For each column, there is a current source 31 that has two output circuitry: one 32 for driving the column electrode in the upper panel through a pad such as 34 and another 33 for driving the column electrode in the lower panel through a pad such as 35.

Although a preferred embodiment of the column driver of the present invention has been shown to be used in conjunction with the dual-scan scheme, the column driver may also be used in conjunction with the single-scan scheme where the panel is not divided into two. For example, pad 34 of FIG. 3 may be connected to a column electrode while pad 35 of FIG. 3 is connected to the next column. In this way, the number of columns that one chip can drive may be doubled.

Figure 4:
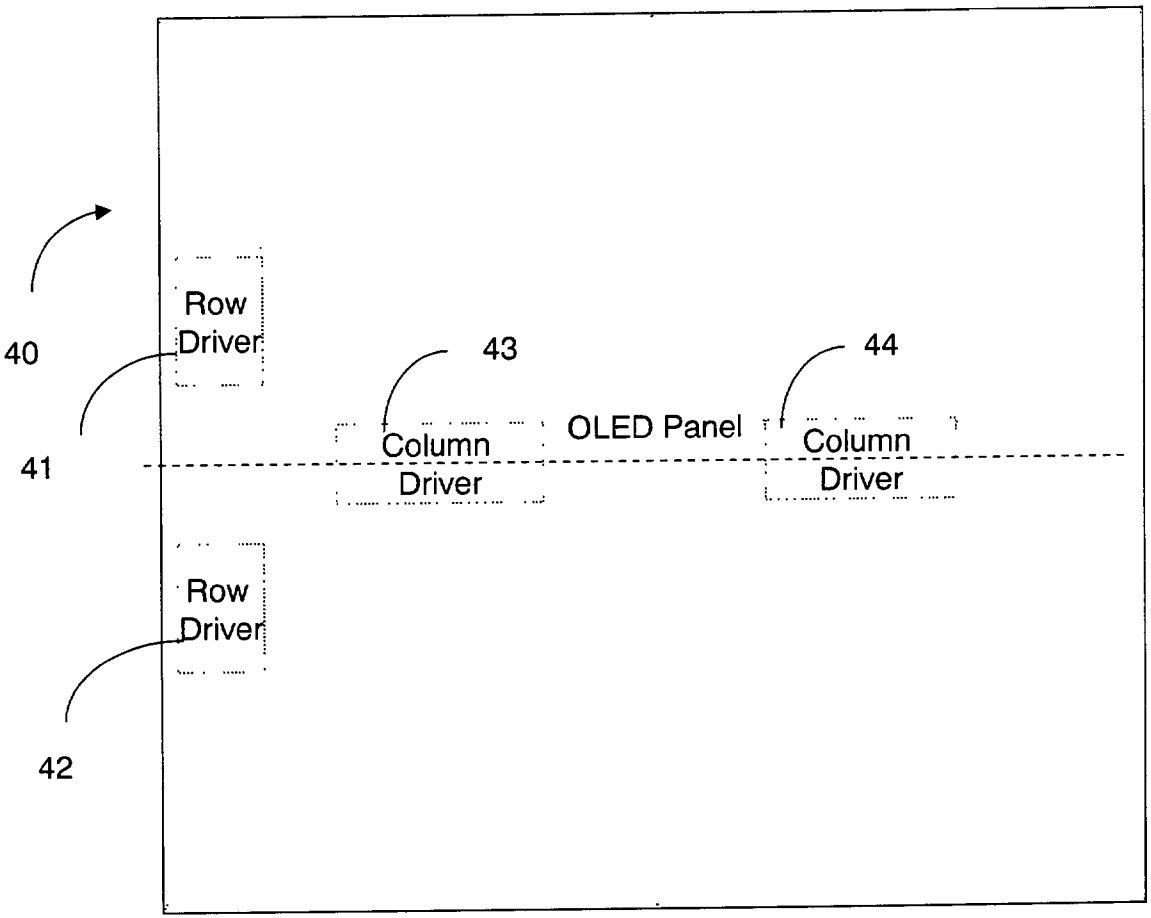
FIG. 4 shows a scheme where the multiple column-drivers of the present invention are used as well as multiple row-drivers using partitioning the panel.

FIG. 4 shows the use of more than one column driver using partitioning. When the OLED panel 40 is larger than that can be handled by a single column driver, several column drivers such as 43 and 44 may be employed so that each column driver is responsible for driving a partition of the entire columns. Similarly, more than one row driver, such as 41 and 42, may be employed so that each row driver is responsible for selecting a row from a partition of the entire rows.

Figure 5:
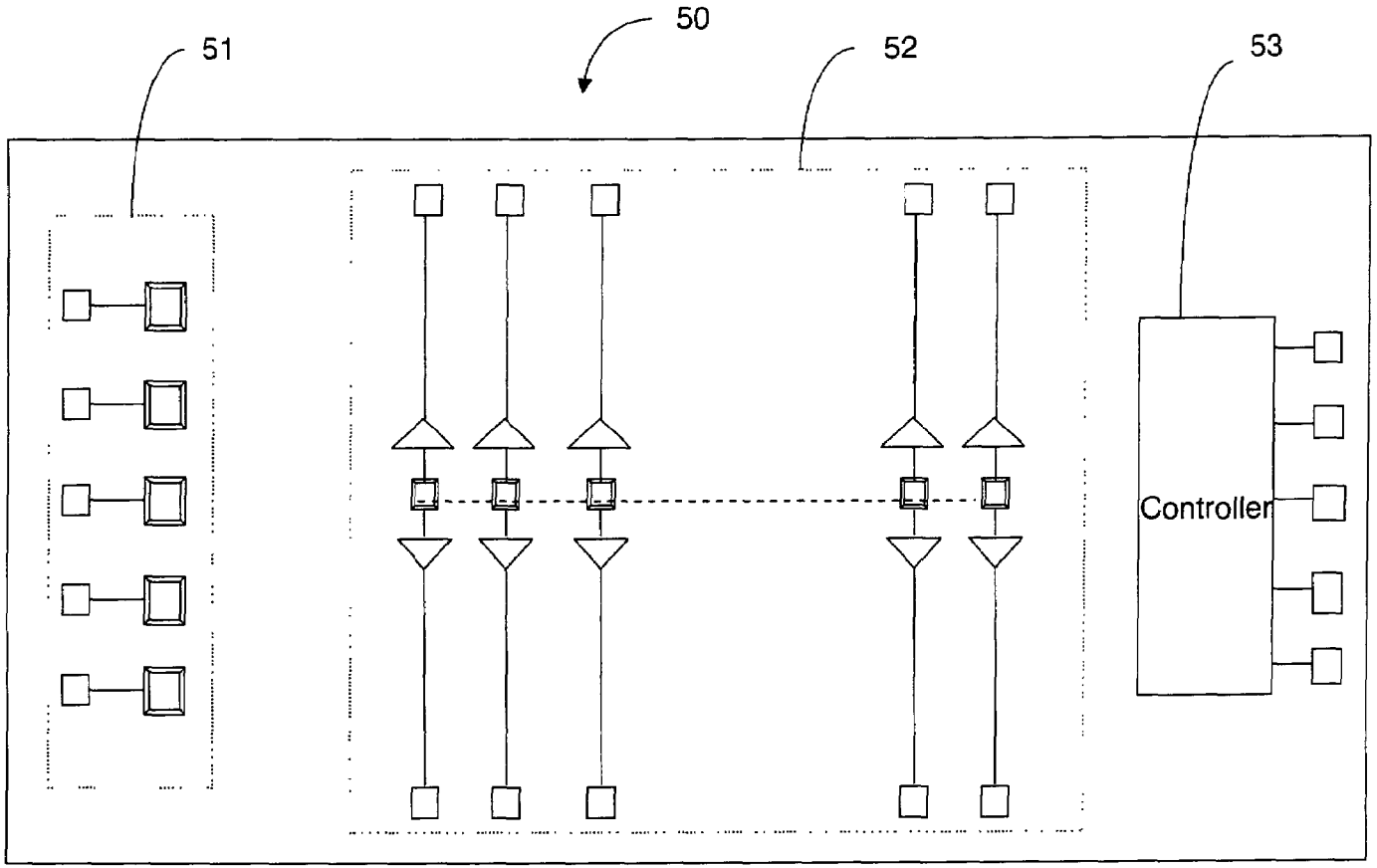
FIG. 5 shows a single chip solution integrating both the row driver and column driver of the present invention as well as a controller for controlling the row and column drivers.

FIG. 5 shows a single chip solution where a single chip 50 includes both a row driver 51 and a column driver 52 for a dual-scan OLED display. It may further include a controller 53 with input pads for providing control information to the row and column drivers. The chip may be designed to further include memory cells for storing graphics data and power circuits (not shown in the figure).

There are many advantages resulting from the present invention. The invention solves the display uniformity problem associated with dual scan without further increasing the part count. The resulting silicon area of a single-chip column driver is smaller than the area of the two-chip column-drivers in the conventional art because the areas for redundant circuits, such as that of a bias generator, can be eliminated. Because lower voltages are used, a processing technology of finer geometry can be used. The present invention also enables the independent current control for RGB without additional design of a mirror-image column driver chip.

While the invention has been described with reference to preferred embodiments, it is not intended to be limited to those embodiments. It will be appreciated by those of ordinary skilled in the art that many modifications can be made to the structure and form of the described embodiments without departing from the spirit and scope of this invention.

What is claimed is:

1. A driver for driving columns of a dual-scan LED (Light-Emitting Diode) panel divided into upper and lower panels each including a plurality of LEDs, comprising:

a current source providing current for driving both first and second column electrodes of a column of the dual-scan LED panel, the first column electrode corresponding to the LEDs of the column in the upper panel and the second column electrodes corresponding to the LEDs of the column in the lower panel;

a first output circuitry coupled to the current source for providing the current from the current source to the first column electrode; and second output circuitry coupled to the current source for providing the current from the current source to the second column electrode.

2. The driver of claim 1, wherein said LED panel is an OLED (Organic Light-Emitting Diode) panel.

3. The driver of claim 1, wherein the driver is located substantially at the center in the back side of the panel.

4. The driver of claim 1, wherein the first output circuitry provides the current from the current source to the first column electrode via a first pad corresponding to the column on the upper panel and the second output circuitry provides the current from the current source to the second column electrode via a second pad corresponding to the column on the lower panel.

5. A method of driving columns of a dual-scan LED (Light-Emitting Diode) panel divided into upper and lower panels each including a plurality of LEDs, using a column driver, comprising:

providing current for driving both first and second column electrodes of a column of the dual-scan LED panel using a current source of the column driver, the first column electrode corresponding to the LEDs in the upper panel and the second column electrode corresponding to the LEDs in the lower panel;

driving the first column electrode with a first output circuitry coupled to the current source using the current provided from the current source; and driving the second column electrode with a second output circuitry coupled to the current source using the current provided from the current source.

6. The method of claim 5, wherein said LED panel is an OLED (Organic Light-Emitting Diode) panel.

7. The method of claim 5, wherein driving the first column electrode comprises providing the current from the current source to the first column electrode via a first pad corresponding to the column on the upper panel and driving the second column electrode comprises providing the current from the current source to the second column electrode via a second pad corresponding to the column on the upper panel.

8. A dual-scan organic light-emitting diode (OLED) display device comprising:

a dual-scan OLED panel divided into upper and lower panels each including a plurality of OLEDs, the OLEDs of a column in the upper panel driven by a first column electrode in the upper panel and the OLEDs of the column in the lower panel driven by a second column electrode in the lower panel; and a column driver including:

a current source providing current for driving both the first and second column electrodes of the dual-scan LED panel;

a first output circuitry coupled to the current source for providing the current from the current source to the first column electrode; and a second output circuitry coupled to the current source for providing the current from the current source to the second column electrode.

9. The dual-scan OLED display device of claim 8, wherein the first output circuitry provides the current from the current source to the first column electrode via a first pad on the upper panel and the second output circuitry provides the current from the current source to the second column electrode via a second pad on the lower panel.

* * * * *

UNITED STATES PATENT AND TRADEMARK OFFICE

CERTIFICATE OF CORRECTION

PATENT NO. : 7,068,248 B2
APPLICATION NO. : 10/232595
DATED : June 27, 2006
INVENTOR(S) : Sung Tae Ahn, Keunmyung Lee, Dae Young Ahn and Tae Kwang Park It is certified that error appears in the above-identified patent and that said Letters Patent is hereby corrected as shown below:

Column 3,

Line 29, please add “a” before --second--

Signed and Sealed this

Twelfth Day of September, 2006

JON W. DUDAS
*Director of the United States Patent and Trademark Office*